US011133613B2

(12) United States Patent
Qin et al.

(10) Patent No.: US 11,133,613 B2
(45) Date of Patent: Sep. 28, 2021

(54) CARD EDGE CONNECTOR WITH IMPROVED PERFORMANCE AT LOW IMPEDANCE AND SUPERIOR HIGH FREQUENCY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Teng Qin, Kunshan (CN); Wen-Jun Tang, Kunshan (CN); Xue-Wu Bu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/844,496

(22) Filed: Apr. 9, 2020

(65) Prior Publication Data

US 2020/0328542 A1 Oct. 15, 2020

(30) Foreign Application Priority Data

Apr. 10, 2019 (CN) ..... 201920481155.X

(51) Int. Cl.
*H01R 12/72* (2011.01)
*H01R 12/57* (2011.01)
(Continued)

(52) U.S. Cl.
CPC ..... *H01R 12/721* (2013.01); *H01R 12/57* (2013.01); *H01R 12/737* (2013.01); *H01R 13/41* (2013.01)

(58) Field of Classification Search
CPC .... H01R 12/721; H01R 12/57; H01R 12/737; H01R 13/41; H01R 12/72
(Continued)

(56) References Cited

U.S. PATENT DOCUMENTS 5,035,631 A * 7/1991 Piorunneck ..... H01R 13/6582 439/108
5,064,391 A * 11/1991 Buchter ..... H01R 13/422 439/733.1
(Continued)

FOREIGN PATENT DOCUMENTS

CN 101295827 B 5/2010
CN 107565280 A 1/2018
(Continued)

*Primary Examiner* — Peter G Leigh
(74) *Attorney, Agent, or Firm* — Ming Chieh Chang; Wei Te Chung

(57) ABSTRACT

A card edge connector includes an insulative housing with a pair of side walls along a longitudinal direction with a receiving slot therebetween in a transverse direction perpendicular to the longitudinal direction. The housing has a bottom wall connecting the pair of side walls and under the receiving slot. A plurality of passageways are formed in the housing to receive the corresponding contacts, respectively. Each contact has a retention section, a resilient contacting section and a horizontal soldering section. A vertical distance between the upper face of the bottom wall and the respective soldering sections is within a range between 2.50 mm and 1.00 mm.

12 Claims, 10 Drawing Sheets

(51) Int. Cl.
*H01R 13/41* (2006.01)
*H01R 12/73* (2011.01)

(58) Field of Classification Search
USPC ..... 439/630
See application file for complete search history.

(56) References Cited

U.S. PATENT DOCUMENTS 6,059,585 A * 5/2000 Liao ..... H05K 7/1409 439/155
7,008,267 B2 * 3/2006 Fan ..... H01R 13/658 439/607.35
7,300,312 B1 * 11/2007 Chen ..... H01R 13/6594 439/607.31
7,438,569 B2 * 10/2008 Pennypacker ..... H01R 13/6335 439/157
7,955,099 B2 * 6/2011 Tan ..... H01R 12/721 439/157
8,083,526 B2 * 12/2011 Long ..... H01R 13/6585 439/60
8,215,994 B2 * 7/2012 Duenas ..... H01R 13/6471 439/637
8,328,567 B1 * 12/2012 Yang ..... H01R 12/7005 439/157
8,403,689 B2 * 3/2013 Li ..... H01R 13/639 439/160
8,435,077 B2 * 5/2013 Yang ..... H01R 12/737 439/637
9,022,809 B2 * 5/2015 Tang ..... H01R 12/721 439/637
10,522,926 B2 * 12/2019 Chen ..... H01R 13/6456
2007/0026722 A1 * 2/2007 Ringler ..... H01R 12/585 439/381
2007/0238323 A1 * 10/2007 Mathews ..... H01R 13/6275 439/65
2010/0178808 A1 * 7/2010 Vrenna ..... H01R 13/62988 439/637
2012/0149223 A1 * 6/2012 Feldman ..... H01R 13/62933 439/157
2012/0322283 A1 * 12/2012 Yang ..... H01R 12/7005 439/157
2012/0329301 A1 * 12/2012 Li ..... H01R 12/721 439/157
2014/0213124 A1 * 7/2014 Wu ..... H01R 13/6467 439/885

FOREIGN PATENT DOCUMENTS

CN 107658583 A 2/2018
CN 109586067 A * 4/2019 ..... H01R 12/716

* cited by examiner

CARD EDGE CONNECTOR WITH IMPROVED PERFORMANCE AT LOW IMPEDANCE AND SUPERIOR HIGH FREQUENCY

BACKGROUND OF THE INVENTION

1. Field of the Invention

The present invention relates generally to an electrical connector, and particularly to the card edge connector equipped with the grounding bar and a relatively low receiving slot therein.

2. Description of Related Arts

The spec of the PCIe (Peripheral Component Interconnect Express) 4.0 has been implemented for a while, in which a card edge connector is utilized. The electrical performance is a concerned issue.

Hence, the specific range for the contact arrangement with regard to the housing is desired.

SUMMARY OF THE INVENTION

To achieve the above object, a card edge connector includes an insulative housing with a pair of side walls along a longitudinal direction with a receiving slot therebetween in a transverse direction perpendicular to the longitudinal direction. The housing has a bottom wall connecting the pair of side walls and under the receiving slot. A plurality of passageways are formed in the housing to receive the corresponding contacts, respectively. Each contact has a retention section, a resilient contacting section and a horizontal soldering section. A vertical distance between the upper face of the bottom wall and the respective soldering sections is within a range between 2.50 mm and 1.00 mm. Specifically, when the vertical distance is 2.42 mm, the distance between the innermost point of the soldering area of the soldering section and the corresponding corner of the center rib of the bottom wall is 3.31 mm. Specifically, when the vertical distance is 2.50 mm, another vertical distance between the contacting point of the contacting section the soldering section is 6.25 mm. With this arrangement, the signal integrity may be optimized, compared with the conventional design having the vertical distance of 3.4 mm between the upper face of the bottom wall and the respective soldering sections which is out of the aforementioned range. The electrical connector is optionally equipped with the grounding bar electrically linking the corresponding grounding contacts. In other words, the arrangement provided by the invention achieves the balanced condition among the required strength of the housing from the mechanical viewpoint, and the desired lower impedance and superior high frequency performance from the electrical viewpoint.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
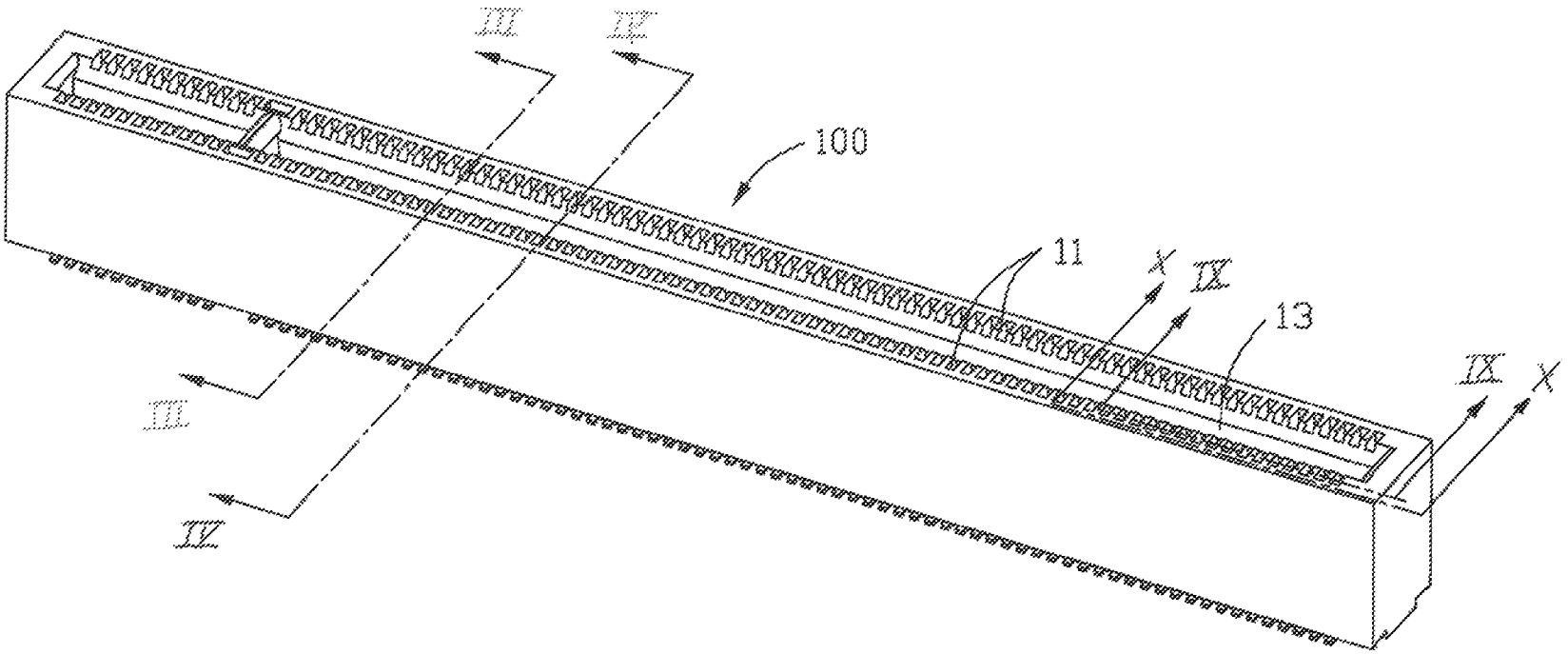
FIG. 1 is a perspective view of the electrical connector of the present invention.
Figure 2:
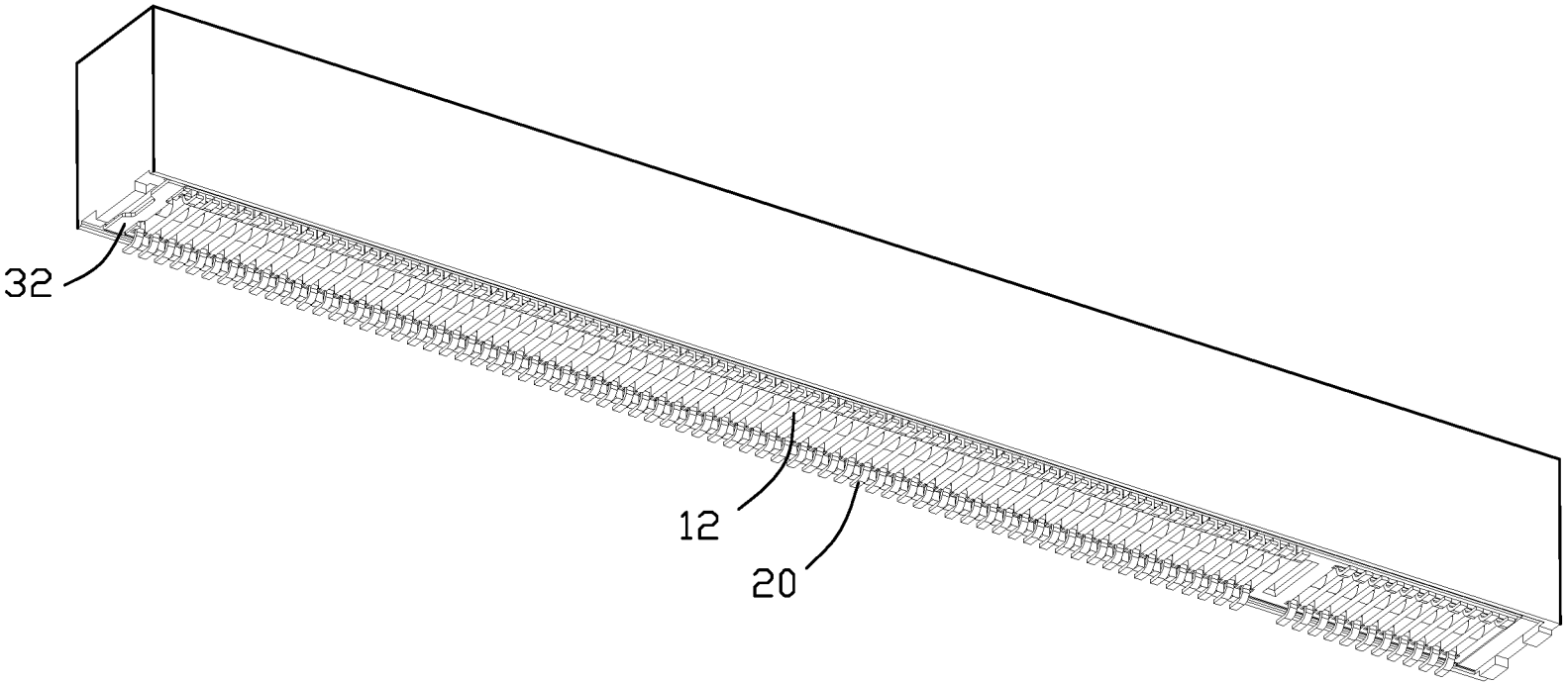
FIG. 2 is another perspective view of the electrical connector of FIG. 1.
Figure 3:
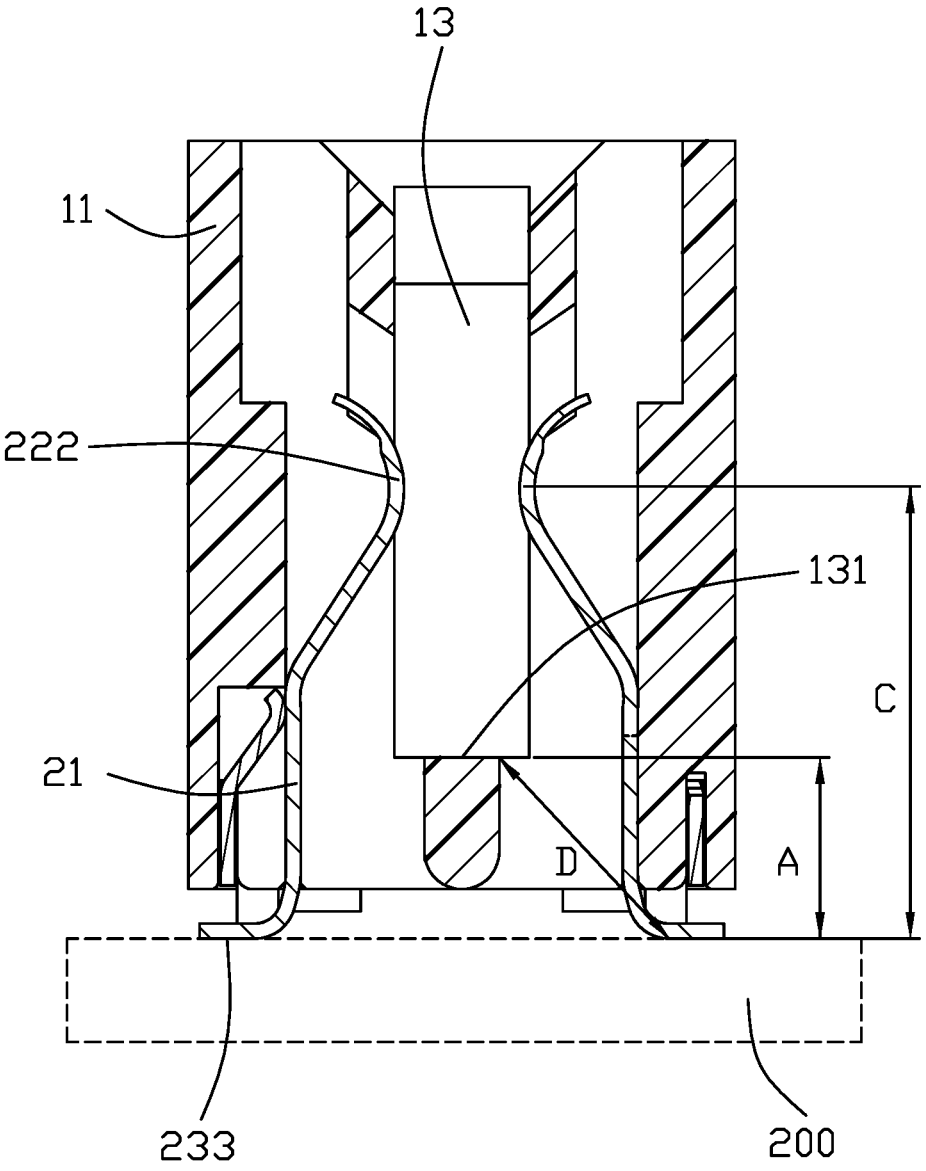
FIG. 3 is a cross-sectional view of the electrical connector along line III-III in FIG. 1.

Referring to FIGS. 1-10, a card edge connector 100, e.g., PCI-e 5.0, is used for mounting upon a printed circuit board 200 for transmission of the high speed signals. The connector 100 includes an insulative housing 10, a plurality of contacts 20 retained to the housing 10. The housing 10 includes a pair of side walls 11 extending along the longitudinal direction, and a bottom wall 12 connected between the pair of side walls 11 in the transverse direction perpendicular to the longitudinal direction. A receiving slot 13 is formed among the pair of side walls 11 and the bottom wall 12. The bottom wall 12 forms an upper abutting surface 131 upwardly confronting the receiving slot 13 for supporting the bottom edge of the memory module (not shown), which is received in the receiving slot 13. The contact 20 includes a retaining section 21, a curved resilient section 22 extending from one end of the retaining section 21 into the passageway 112, and a mounting leg 23 extending from the other end of the retaining section 21. The resilient section 22 includes a contacting section 222 extending into the receiving slot 13, and the mounting leg 23 includes a horizontal soldering section 232 for surface mounting to the corresponding soldering face 233 of the printed circuit board 200. A vertical distance between the upper abutting surface 131 and the soldering face 233 is represented with A which is within a range between 2.5 mm and 1.00 mm. Notably, the traditional distance A is essentially equal to 3.40 mm much larger than that of the invention. Understandably, the optimal value of distance A is 2.42 mm so as to enhance the signal integrity thereof. Specifically, when the vertical distance A is 2.42 mm, the distance D defined between the innermost point of the soldering area of the soldering section and the corresponding corner of the center rib of the bottom wall is 3.31 mm. On the other hand, when the vertical distance A is 2.50 mm, another vertical distance C defined between the contacting point of the contacting section 222 and the soldering face 233 is 6.25 mm.

Figure 5:
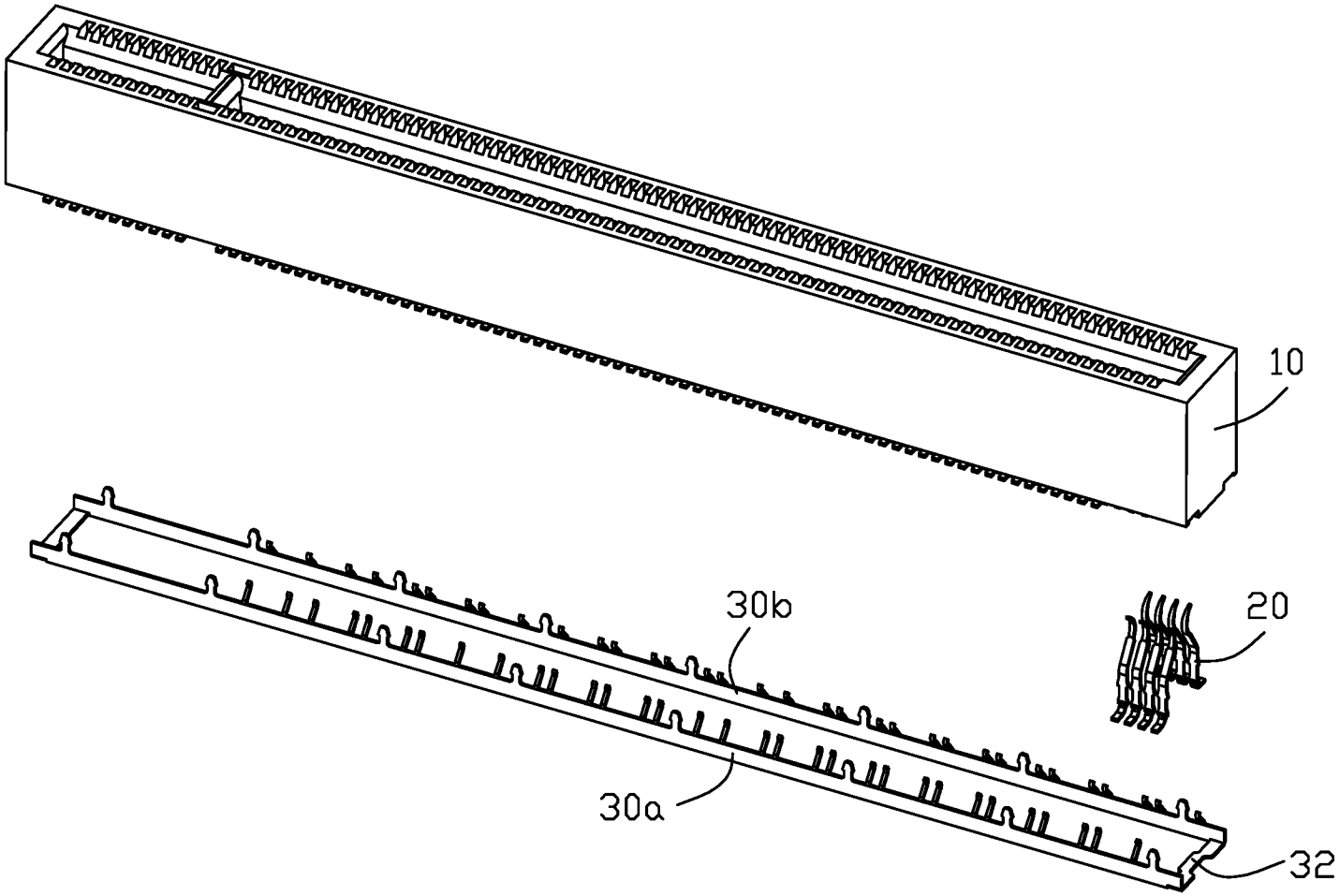
FIG. 5 is an exploded perspective view of electrical connector of FIG. 1.
Figure 6:
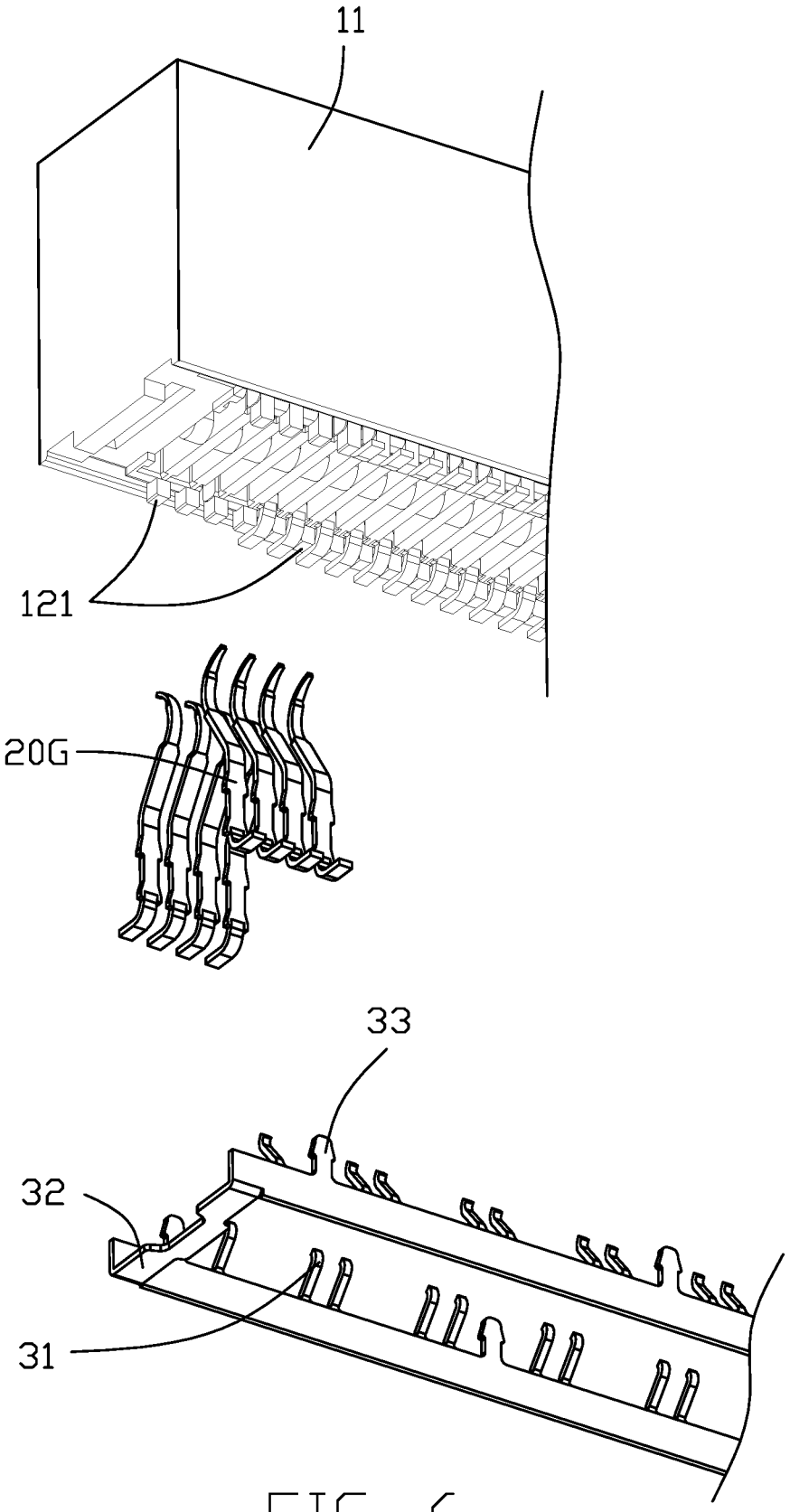
FIG. 6 is an exploded perspective view of a portion of the electrical connector of FIG. 5.

Referring to FIGS. 5 and 6, the contacts 20 are arranged with two rows respectively located on the pair of side walls 11. Each row of contacts 2 include the grounding contacts 20G. A pair of grounding bars 30*a*, 30*b* are attached to the corresponding side walls 11, respectively. Each grounding bar 30*a*, 30*b* includes a plurality of spring fingers 31 to electrically and mechanically connect to the corresponding grounding contacts 20G. The pair of grounding bars 30*a*, 30*b* are connected with each other via a pair of transverses bars 32 abutting against a bottom surface of the bottom wall 12. Each grounding bar 30*a*, 30*b* includes lances 33 retaining the corresponding grounding bar 30*a*, 30*b* to the corresponding side wall 11.

Figure 7:
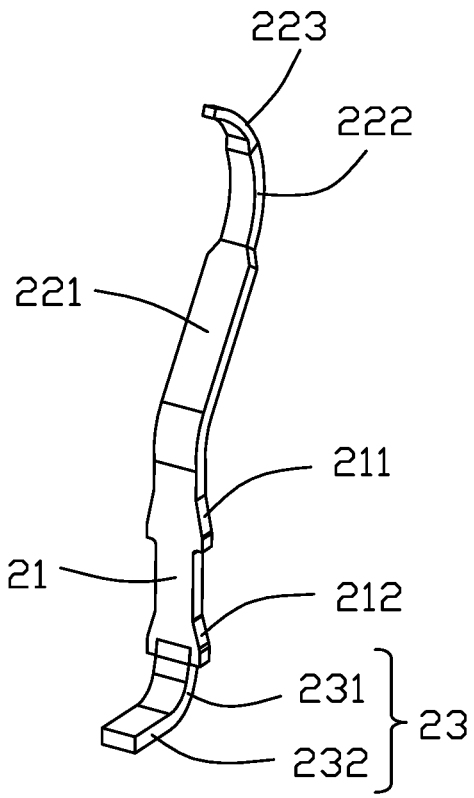
FIG. 7 is a perspective view of the contact of the electrical connector of FIG. 1.

Referring to FIG. 7, the resilient section 22 includes an oblique section 221 extending upwardly from the retaining section 21, and the contacting section 222 extends from the oblique section 221 in relative narrow manner. The end section 223 is located at the end of the contacting section 222 with a narrowed and thinned structure compared with the contacting section 222. In detail, a step structure is formed an outward surface of the contacting section 222 around the border of the end section 223. The mounting leg 23 includes a linking section 231 and the soldering section 232 extends from the linking section 231. The bottom wall 12 forms a plurality of partitions 121 to separate the neighboring mounting legs 23, respectively, for assuring the coplanarity of the soldering sections 232 and the high frequency transmission.

Figure 8:
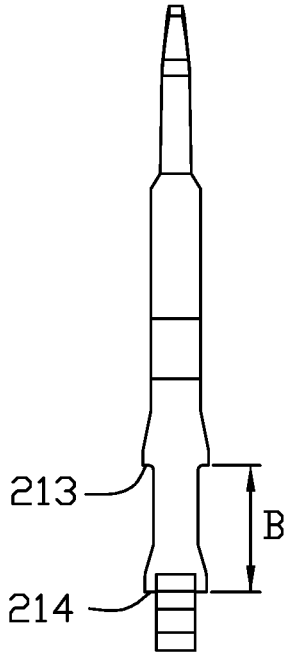
FIG. 8 is elevational view of the contact of the electrical connector of FIG. 7.
Figure 9:
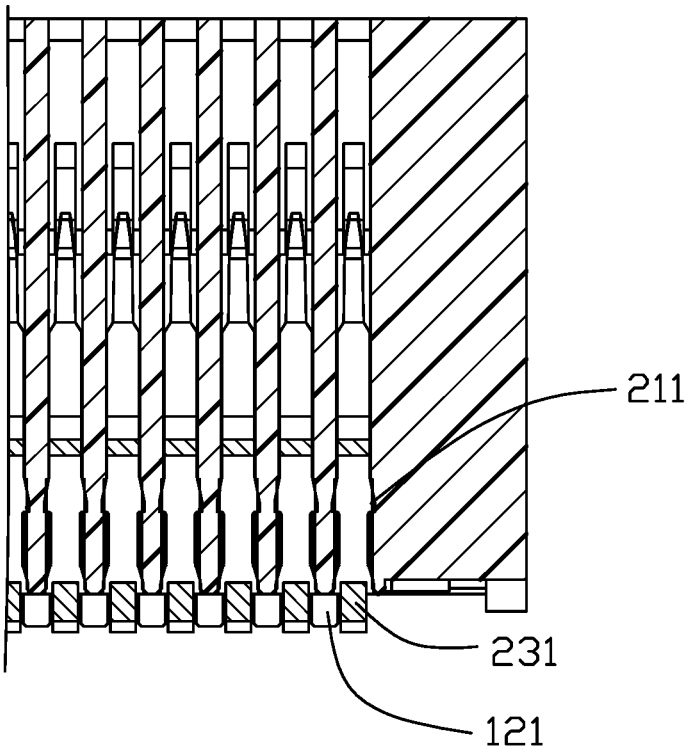
FIG. 9 is a cross-sectional view of the electrical connector of FIG. 1 along line IX-IX.
Figure 10:
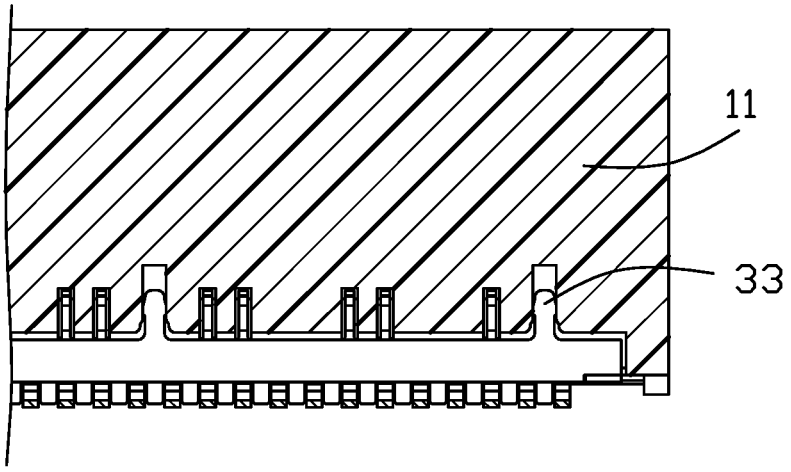
FIG. 10 is a cross-sectional view of the electrical connector of FIG. 1 along line X-X.

Referring to FIGS. 7 and 8, the retaining section 21 of the contact 20 includes upper barbs 211 and lower barbs 212 each having the step 213, 214 toward the printed circuit board 200. A distance B is formed between the steps 213 and 214. In this embodiment, the distance B is defined within a range between 1.10 mm and 2.00 mm. In this embodiment, the distance B is 1.43 mm. Notably, the larger the distance B is, the smaller the interference occurring between the neighboring contacts 20.

Figure 4:
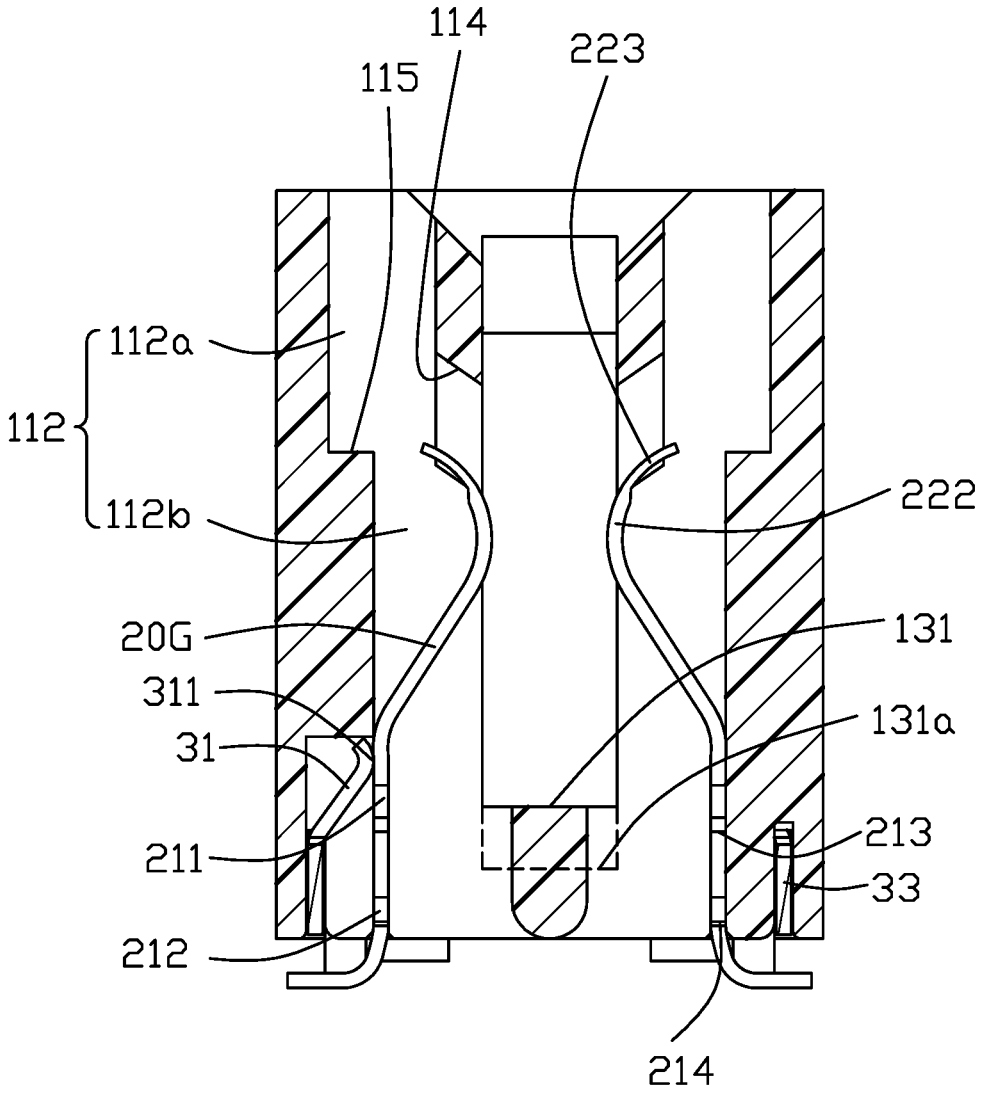
FIG. 4 is another cross-sectional view of the electrical connector of FIG. 1 along line IV-IV.

Referring to FIG. 4, the upper abutting surface 131 is located around the upper barbs 211, and the contact point between the spring fingers 31 and the corresponding grounding contact 20G is located above the upper barbs 211. In another embodiment as shown in the dashed line in FIG. 4, the upper abutting surface 131 may be located between the steps 213 of the upper barbs 211 and the step 214 of the lower barbs 212. The passage 112, which receives the corresponding contact 20, includes an upper part 112*a* extending upwardly through the upper face of the corresponding side wall 11, and a lower part 112*b* communicating with the receiving slot 13. A downward face 114 and an upward face 115 are formed around an interface between the upper part 112*a* and the lower part 112*b*. The end section 223 of the contacting section 22 is moveable around the downward face 114 and the upward face 115.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for mounting to a printed circuit board and receiving a memory module, comprising:

an insulative elongated housing having a pair of side walls extending along a longitudinal direction with a receiving slot therebetween in a transverse direction perpendicular to the longitudinal direction for receiving the memory module, and a bottom wall linked between the pair of side walls in the transverse direction and having an upper abutting surface located below the receiving slot for upwardly confronting the memory module which is adapted to be received within the receiving slot;

a plurality of passageways formed in each of the side walls;

a plurality of contacts disposed in the corresponding passageways, respectively, each of the contacts including a retaining section to be retained to the housing, a resilient section extending upwardly from an upper end of the retaining section, a contacting section extending from the resilient section and into the receiving slot, a mounting leg extending from a bottom end of the retaining section, and a horizontal soldering section extending from the mounting leg for mounting to a soldering face of the printed circuit board; and a vertical distance between said upper abutting face and the soldering face is within a range defined between 1.00 mm and 2.50 mm; wherein the retaining section is equipped with upper barbs and lower barbs, and the upper abutting surface is located at a level between the corresponding upper barbs and lower barbs; and a vertical distance between the upper barbs and the lower barbs is within a range between 1.10 mm and 2.00 mm.

2. The electrical connector as claimed in claim 1, wherein each of the side walls further is equipped with a grounding bar having spring fingers respectively mechanically and electrically connecting to corresponding grounding contacts of said plurality of contacts, and a contact point between the spring finger and the corresponding grounding contact is located above the upper barbs.

3. The electrical connector as claimed in claim 1, where the contacting section forms a contact point for connecting to the memory module, and a vertical distance between the contact point and the soldering face is 6.25 mm.

4. The electrical connector as claimed in claim 1, wherein the bottom wall forms a plurality of partitions around a bottom face corresponding to the neighboring passageways, respectively, so as to separate the corresponding mounting legs, respectively.

5. The electrical connector as claimed in claim 1, wherein in each contact, an end section is formed at an upper end of the corresponding contacting section, and the contacting section is narrower than the corresponding retaining section while the end section is narrower and thinner than the corresponding contacting section.

6. The electrical connector as claimed in claim 5, wherein each passageway includes an upper part and a lower part with an upward face and a downward face around which the end section of the contact is moveable.

7. An electrical connector for mounting to a printed circuit board and receiving a memory module, comprising:

an insulative elongated housing having a pair of side walls extending along a longitudinal direction with a receiving slot therebetween in a transverse direction perpendicular to the longitudinal direction for receiving the memory module, and a bottom wall linked between the pair of side walls in the transverse direction and having an upper abutting surface located below the receiving slot for upwardly confronting the memory module which is adapted to be received within the receiving slot;

a plurality of passageways formed in each of the side walls;

a plurality of contacts disposed in the corresponding passageways, respectively, each of the contacts including a retaining section to be retained to the housing, a resilient section extending upwardly from an upper end of the retaining section, a contacting section extending from the resilient section and into the receiving slot, a mounting leg extending from a bottom end of the retaining section, and a horizontal soldering section extending from the mounting leg for mounting to a soldering face of the printed circuit board; and a vertical distance between said upper abutting face and the soldering face is within a range defined between 1.00 mm and 2.50 mm; wherein the contacting section forms a contact point for connecting to the memory module, and a vertical distance between the contact point and the soldering face is 6.25 mm.

8. The electrical connector as claimed in claim 7, wherein the retaining section is equipped with upper barbs and lower barbs, and the upper abutting surface is located at a level between the corresponding upper barbs and lower barbs.

9. The electrical connector as claimed in claim 8, wherein each of the side walls further is equipped with a grounding bar having spring fingers respectively mechanically and electrically connecting to corresponding grounding contacts of said plurality of contacts, and a contact point between the spring finger and the corresponding grounding contact is located above the upper barbs.

10. The electrical connector as claimed in claim 7, wherein the bottom wall forms a plurality of partitions around a bottom face corresponding to the neighboring passageways, respectively, so as to separate the corresponding mounting legs, respectively.

11. The electrical connector as claimed in claim 7, wherein in each contact, an end section is formed at an upper end of the corresponding contacting section, and the contacting section is narrower than the corresponding retaining section while the end section is narrower and thinner than the corresponding contacting section.

12. The electrical connector as claimed in claim 11, wherein each passageway includes an upper part and a lower part with an upward face and a downward face around which the end section of the contact is moveable.

* * * * *